United States Patent [19]

Ferrara

[11] 4,441,225

[45] Apr. 10, 1984

[54] SHOESHINING MACHINE AND METHOD OF SUPPORTING SHOE DURING SHINING

[76] Inventor: Frank Ferrara, 659 East 187th St., Bronx, N.Y. 10458

[21] Appl. No.: 328,142

[22] Filed: Dec. 7, 1981

[51] Int. Cl.[3] ..... A47L 23/02

[52] U.S. Cl. ..... 15/34

[58] Field of Search ..... 15/30, 31, 32, 34, 35, 15/97 A, 310

[56] References Cited

U.S. PATENT DOCUMENTS

| | | | |
|---|---|---|---|
| 715,118 | 12/1902 | Muller | 15/34 |
| 3,365,741 | 1/1968 | Smagula | 15/32 |
| 3,497,896 | 3/1970 | Richardson | 15/32 |
| 3,729,761 | 5/1973 | Lashley | 15/34 |

*Primary Examiner*—Edward L. Roberts

[57] ABSTRACT

A portable shoeshining machine is provided. The machine comprises an elongated housing having front and rear ends and sides. A shoe entry means is provided on the front end for inserting the shoe into the housing. A shoe support means is also provided for supporting the shoe in a stationary manner in the housing with the elongated axis of the shoe substantially parallel to the elongated axis of the housing. A plurality of cylindrical rotating buffing brushes are provided which are movable along the axis of the housing and surround and are in contact with the sides and top of the shoe. A means is provided for moving the brushes back and forth along the axis of the housing and simultaneously rotating the brushes. A means is also provided for applying shoe polish to the brushes. A shoe support means is provided for insertion into the shoe for supporting the sides and top of the shoe during the shining operation.

A method is provided for supporting the sides and top of the shoe during shining. The method comprises inserting into the shoe an inflatable bladder and inflating the bladder to an effective pressure to support the sides and top of the shoe and to protect the inside of the shoe from polish.

5 Claims, 2 Drawing Figures

SHOESHINING MACHINE AND METHOD OF SUPPORTING SHOE DURING SHINING

BACKGROUND OF THE INVENTION

1. Field of the Invention

This invention relates to a shoeshining machine, and in particular a portable shoeshining machine suitable for use, for example, in a residential environment and having means for supporting the sides and top of the shoe during the shining operation and to protect the inside of the shoe from polish.

2. Prior Art

There are many type shoeshining machines known in the art. Most of these machines are very complicated mechanisms designed for industrial use or for use in public places, i.e. train stations, lobbies, etc. where the use patterns of the machine justifies the cost of the machine. Exempliary of such machines are those described in the following U.S. patents:

U.S. Pat. No. 1,055,979 to Oliver et al;
U.S. Pat. No. 1,491,012 to Johnson;
U.S. Pat. No. 1,648,578 to Croy;
U.S. Pat. No. 1,654,049 to Newton;
U.S. Pat. No. 1,692,120 to Hoffman;
U.S. Pat. No. 2,281,131 to Wright;
U.S. Pat. No. 2,534,131 to Jenkins;
U.S. Pat. No. 3,010,130 to Ferrari; and
U.S. Pat. No. 3,022,528 to Pagano.

Additionally, due to the contour of a typical shoe it is necessary, as shown by the foregoing references, to angle the brushes at various odd angles to alleviate pressure on the shoe and prevent polish being applied to the inside of the shoe. If this is not done a shoe without a foot in it tends to collapse, and have an undesirable quantity of polish applied to the inside of the shoe.

OBJECTS AND SUMMARY OF THE INVENTION

It is an object of this invention to provide a portable shoeshining machine suitable for use in a residential environment.

It is a further object of this invention to provide a portable shoeshining machine which is easy to construct, inexpensive and sturdy.

It is still a further object of this invention to provide a portable shoeshining machine which permits contact of the brushes with all of the surfaces of the shoe without collapse of the sides and top of the shoe.

It is a further object of this invention to provide a portable shoeshining machine which operates automatically to completely shine the shoe without collapse of the sides and top of the shoe and without the interior of the shoe and the operator being soiled by the operation.

All of the foregoing objects and other objects are accomplished by the portable shoe shining machine of this invention. The machine comprises:

(a) an elongated housing having front and rear ends and sides;
(b) a shoe entry means on the front end for inserting the shoe into the housing;
(c) a shoe support means for supporting the shoe in a stationary manner in the housing, the elongated axis of the shoe substantially parallel to the elongated axis of the housing;
(d) a plurality of cylindrical rotating buffing brushes movable along the axis of the housing and surrounding and in contact with the sides and top of the shoe;
(e) means for moving the brushes back and forth along the axis of the housing and simultaneously rotating the brushes;
(f) means for applying shoe polish to the brushes; and
(g) a shoe support means for insertion into the shoe for supporting the sides and top of the shoe during shining.

A method is also provided for supporting the sides and top of the shoe during the shining operation which comprises inserting into the shoe an inflatable bladder and inflating the bladder to an effective pressure to support the sides and top of the shoe and to protect the inside of the shoe from polish.

BRIEF DESCRIPTION OF THE DRAWINGS

The various features of the shoeshining machine of this invention by which the foregoing objects are achieved will be evident from the following description taken in conjunction with the accompanying drawings, in which.

DETAILED DESCRIPTION OF THE INVENTION

Figure 1:
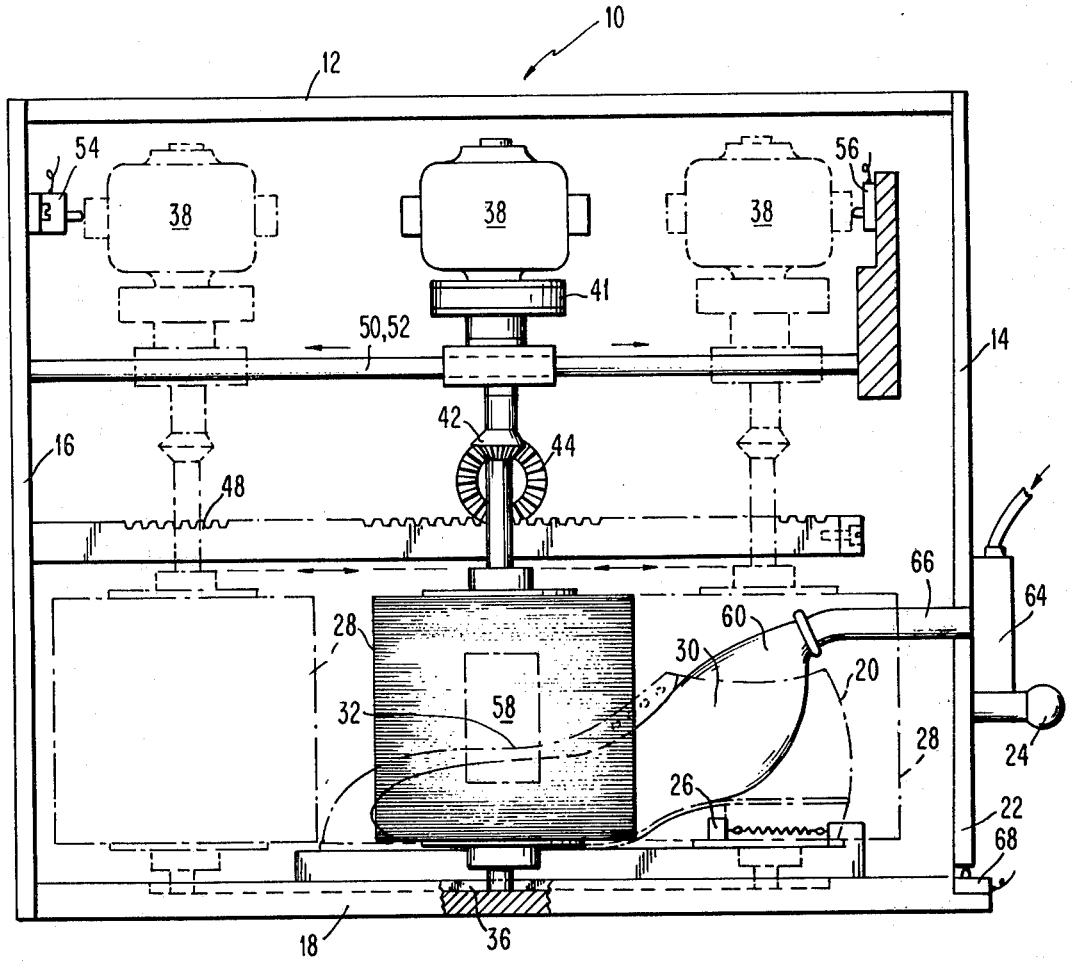
FIG. 1 is a longitudinal side elevation of an embodiment of the portable shoeshining machine of this invention.
Figure 2:
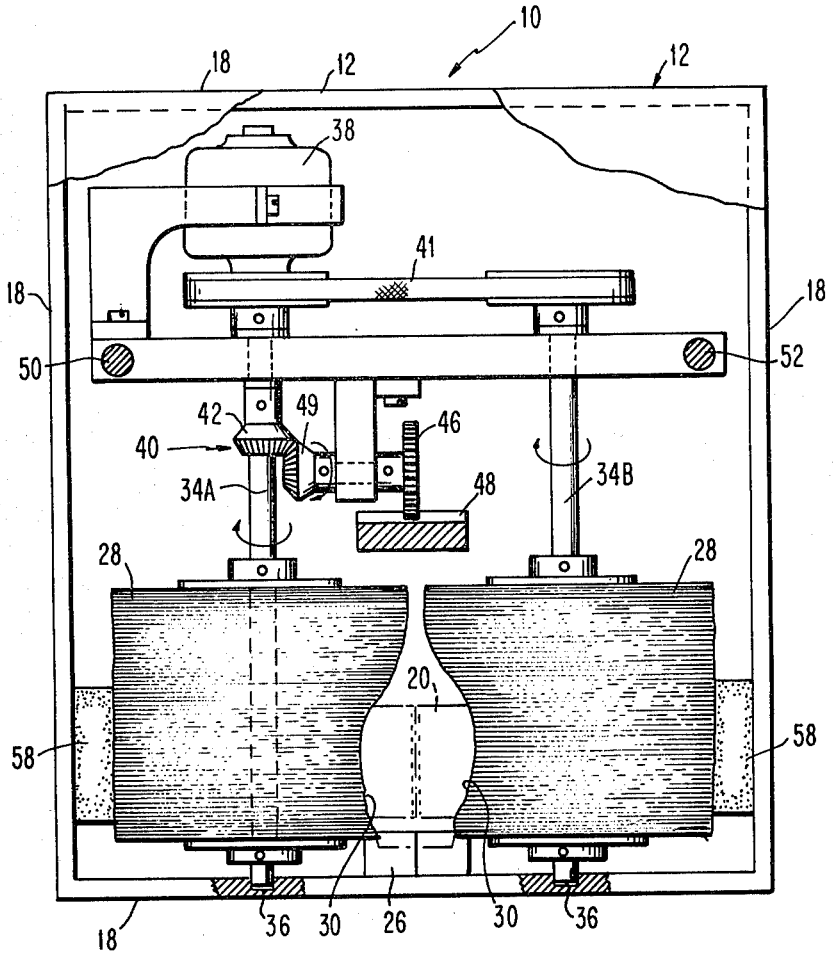
FIG. 2 is a vertical front elevation of the shoe shining machine shown in FIG. 1.

Referring to FIGS. 1 and 2, the shoeshining machine of this invention, generally designated (10) is enclosed by an elongated housing (12) having front and rear ends (14 & 16, respectively) and sides (18). The housing (12) may be of any shape, e.g. cylindrical, box like, etc. as long as it is of a length and height suitable to enclose the shoe (20) and the working parts of the shoeshining machine (10). It may be constructed of wood, plastic, metal etc. By the use of the term "elongated" as used herein, it is meant a housing (12) of a length suitable for enclosing the shoe (20) which is elongated and the working parts of the machine. Generally, this contemplates a housing of a length longer than the height or width of the housing, however, this does not exclude the possibility of having the height and/or width of the housing (12) of a greater dimension than the length.

A shoe entry means is provided at the front end (14) for inserting the shoe (20) into the housing (12). Preferably, the entry means is a doorway (22) which slides upward to open the entry means and downward to close the entry means. The doorway (22) may be provided with a handle (24) to assist in raising and lowering the doorway (22).

A shoe support means (26) is provided for supporting the shoe (20) in a stationary manner in the housing (12). The shoe (20) is supported in the housing so that the elongated axis of the shoe (20) is substantially parallel to the elongated axis of the housing (12). By the use of the term "elongated axis" of the shoe (20) it is meant an imaginary line from the center of the heel of the shoe to the center of the toe along the length of the shoe. The shoe support means (26) may be a clamp and a spring means which grasps the heel and/or sole of the shoe to maintain the shoe stationary as the buffing brushes pass thereover.

A plurality of cylindrical rotating buffing brushes (28) are also provided. These brushes (28) are movable along the axis of the housing (12). They surround and are in contact with the sides (30) and top (32) of the shoe (20). The brushes (28) are rotatably mounted on axles (34*a* & *b*). The bottom of axles (34) are slidably mounted in slots (36) which are parallel to the elongated axis of the housing (12).

A means is provided for moving the brushes (28) back and forth along the axis of the housing (12) and simultaneously rotating the brushes (28). This is accomplished by providing a drive means at the upper end of each axle (34) coupled to a drive motor (38). One axle (34*a*) is directly coupled to motor (38) and the other axle (34*b*) is directly coupled to motor (38) and the other axle (34*b*) is coupled to a drive belt (41) which is coupled to motor (38). Thus when the motor drive shaft rotates it rotates both axles (34*a* & 34*b*). A means is also provided for simultaneously moving the brushes (38) back and forth along the axis of the housing (12). This is accomplished by attaching a gear means (40) to axle (24*a*) for translating the rotation of axle (34*a*) into longitudinal motion along the axis of the housing (12) i.e. rotating gear (42) drives gear (44) which drives pinon (46) along rack (48) which is parallel to the elongated axis of the housing (12). The motor, axles and gears thus move back and forth along rods (50 and 52). At the end of rods (50 and 52) pressure sensitive switches (54 & 56) are provided. As depicted in FIG. 1, the brushes (28 travel from position A through position B until position C is reached wherein pressure sensitive switch (54) is contacted and reverses the rotation of motor (38) causing the brushes to travel to position B and then A. Pressure sensitive switch (56) can then either stop the cycle or repeat the cycle again. Preferably, pressure sensitive switch (56) stops the cycle so that the shoe may be removed and another shoe placed therein.

A means is provided for applying the shoe polish to the brushes (28). Preferably, as indicated in FIG. 2, shoe polish is provided to the brushes (28) from containers (58) mounted on the sides (18) of housing (20). The brushes (28) as they pass the containers (58) pick up shoe polish contained therein. Preferably the containers (58) are located near the front end (14) of the housing (12) so that the brushes (28) pick up the shoe polish at the beginning of the cycle to apply them to the shoe (20) and shine the shoe on the return cycle.

A shoe support means is inserted in the shoe (20) for supporting the sides (30) and top (32) of the shoe (20) during the shining operation. Preferably the shoe support means is an inflatable bladder (60) which is inflated during shining to an effective pressure to support the sides (30) and top (32) of the shoe (20) and to protect the inside of the shoe from polish. Typically, the pressure may be from 5 to 50 psi. As indicated more clearly in FIG. 1, the bladder opening (62) for inflation is in fluid communication with an external pump (not shown). Preferably this is provided through tubing (66) which connects the air pump with bladder opening (62). The tubing (66) passes through the entry means, i.e. doorway (22) and is attached to the air pump (64). Optionally, the air pump may be provided with tubing capable of inflating a bladder outside the environment of the shoe shining machine to permit the bladder to be used in a shoe to maintain the shape of the shoe while the shoe is not in use.

As indicated in FIG. 1, it is preferred that when doorway (22) closes it activates switch (68) which activates air pump (64) to inflate the bladder (60) to the effective pressure. The effective pressure is then utilized to activate a buffing activation means, i.e. an activation switch to motor (38), which activates the motor to both rotate the buffing brushes (28) and move the brushes along the axis of housing (12). Upon motor (38) hitting pressure sensitive switch (56) the buffing is inactivated and deinflation of the bladder activated. Typically this may be accomplished by sending an electrical impulse to a pressure release means located, for example in tubing (66) (not shown).

Thus in use, one places a shoe (20) (preferably without shoelaces and clipped closed) in the shoe support means (26) closes doorway (22) to activate switch (68) which sends an electrical impulse to the pump (64) to inflate bladder (60). Upon reaching effective pressure an electrical impulse is then sent to motor (38). The rotation of the motor (38) drives the brushes to pressure sensitive switch (54) which reverses the rotation of the motor to drive the brushes so that the motor contacts pressure sensitive switch (56) which shuts off the motor and deflates the bladder. During the movement of the buffing brushes (28) back and forth along the axis of the housing (12) they pick up shoe polish in containers (58). Upon completion of the cycle the doorway is opened, the shoe removed and the next shoe inserted therein.

This invention is also directed to a method of supporting the sides and top of a shoe during a shining operation, no matter what type of shoe shining machine is utilized. This is accomplished by inserting into the shoe an inflatable bladder (as exemplified in FIG. 1 by (60)) and inflating the bladder (60) to an effective pressure to support the sides and top of the shoe, and to protect the inside of the shoe from polish. An effective pressure may be about 5 to about 50 psi. This method may be used in both residential, commercial and in public type shoeshining machines.

It should be understood that the drawings and descriptions herein are illustrative only, and that various modifications may be made without departing from the spirit of the invention. It would be further understood that it is not intended to limit the invention to the details described herein except in so far as they are specifically set out in the claims.

What is claimed is:

1. A portable shoe shining machine comprising:

(a) an elongated housing having front and rear ends and sides;

(b) a shoe entry means on the front end for inserting the shoe into the housing;

(c) a shoe support means for supporting the shoe in a stationary manner in the housing, the elongated axis of the shoe substantially parallel to the elongated axis of the housing;

(d) a plurality of cylindrical rotating buffing brushes movable along the axis of the housing and surrounding and in contact with the sides and top of the shoe;

(e) means for moving the brushes back and forth along the length of the housing and simultaneously rotating the brushes;

(f) means for applying shoe polish to the brushes; and (g) an interior shoe support means for insertion into the shoe for supporting the sides and top of the shoe during shoe shining, wherein the interior shoe support means is an inflatable bladder which is inflated to an effective pressure to support the sides and top of the shoe and to protect the inside of the shoe from polish.

2. The shoeshining machine of claim 1, wherein the bladder opening for inflation is in fluid communication, through the entry means, with an external air pump.

3. The shoeshining machine of claim 2, wherein the entry means is a doorway.

4. The shoeshining machine of claim 2, further comprising an inflation activation means for activating the pump to inflate the bladder to the effective pressure.

5. The shoeshining machine of claim 3, further comprising an inflation activation means for activating the pump to inflate the bladder to the effective pressure when the doorway is closed.

* * * * *